US008853923B2

(12) United States Patent
Kawabata et al.

(10) Patent No.: US 8,853,923 B2
(45) Date of Patent: Oct. 7, 2014

(54) DISCHARGE TUBE AND LIGHT-EMITTING APPARATUS PROVIDED WITH DISCHARGE TUBE

(75) Inventors: Erika Kawabata, Kyoto (JP); Katsushi Sumisaki, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 14/232,937

(22) PCT Filed: Jul. 24, 2012

(86) PCT No.: PCT/JP2012/004690

§ 371 (c)(1),
(2), (4) Date: Jan. 15, 2014

(87) PCT Pub. No.: WO2013/021558

PCT Pub. Date: Feb. 14, 2013

(65) Prior Publication Data

US 2014/0159570 A1 Jun. 12, 2014

(30) Foreign Application Priority Data

Aug. 5, 2011 (JP) ..... 2011-171577

(51) Int. Cl.

| | |
|---|---|
| ***H01J 5/48*** | (2006.01) |
| ***H01J 5/50*** | (2006.01) |
| ***H01R 33/02*** | (2006.01) |
| ***H01J 61/36*** | (2006.01) |
| ***H01J 5/62*** | (2006.01) |
| ***H01J 61/06*** | (2006.01) |
| *H01R 4/48* | (2006.01) |

(52) U.S. Cl.

CPC ..... *H01J 61/06* (2013.01); *H01J 61/36* (2013.01); *H01J 5/50* (2013.01); *H01R 4/48* (2013.01); *H01J 5/62* (2013.01)

USPC ..... 313/51; 313/50; 313/623; 313/625; 362/378; 362/217.01; 362/97.1; 439/232; 439/241; 439/242

(58) Field of Classification Search

CPC ..... H01R 33/08–33/09

USPC ..... 313/49–51, 623–625; 439/226–244; 362/97.1, 378, 217.01, 217.13, 217.17

See application file for complete search history.

(56) References Cited

U.S. PATENT DOCUMENTS 6,869,300 B2 * 3/2005 Lefki et al. ..... 439/242
7,615,935 B2 * 11/2009 Takata ..... 315/229

(Continued)

FOREIGN PATENT DOCUMENTS

JP 03-046982 U 4/1991
JP 09-090481 A 4/1997

(Continued)

OTHER PUBLICATIONS

International Search Report for Application No. PCT/JP2012/004690, dated Oct. 30, 2012.

*Primary Examiner* — Mariceli Santiago
(74) *Attorney, Agent, or Firm* — RatnerPrestia

(57) ABSTRACT

A discharge tube of the present invention includes a glass bulb in which noble gas is enclosed, a pair of electrodes protruding from both ends of the glass bulb in the longitudinal direction of the glass bulb, and a connector connected to each of the electrodes. Each of the electrodes includes at least an axis section and a large-diameter section with a step section and a circumferential face. The step section has a first latching section for latching onto the connector. The circumferential face has a contact section with which the connector comes in contact. The connector includes a connector body into which the electrode is inserted, a second latching section for latching onto the first latching section of the electrode, and a connecting section connected to the contact section of the electrode. This achieves a discharge tube with high connection reliability and high heat radiation efficiency, and a light-emitting apparatus provided with this discharge tube.

5 Claims, 7 Drawing Sheets

(56) References Cited

U.S. PATENT DOCUMENTS

| | | | | |
|---|---|---|---|---|
| 7,976,314 | B2 * | 7/2011 | Ohmori et al. | 439/33 |
| 8,104,918 | B2 * | 1/2012 | Hsiao | 362/217.09 |
| 8,319,901 | B2 * | 11/2012 | Takata et al. | 362/225 |
| 8,334,655 | B2 * | 12/2012 | Nien et al. | 439/33 |
| 8,641,218 | B2 * | 2/2014 | Yu | 362/97.1 |
| 2006/0279957 | A1 * | 12/2006 | Kwon et al. | 362/378 |
| 2008/0218049 | A1 | 9/2008 | Shirasu et al. | |

FOREIGN PATENT DOCUMENTS

| | | | |
|---|---|---|---|
| JP | 2002-164021 | A | 6/2002 |
| JP | 2006-324012 | A | 11/2006 |
| JP | 2006-344602 | A | 12/2006 |
| JP | 2008-130342 | A | 6/2008 |
| JP | 2009-238553 | A | 10/2009 |
| WO | WO 2008/026709 | A1 | 3/2008 |
| WO | WO 2011/162067 | A1 | 12/2011 |

* cited by examiner

DISCHARGE TUBE AND LIGHT-EMITTING APPARATUS PROVIDED WITH DISCHARGE TUBE

TECHNICAL FIELD

The present invention relates to discharge tubes and light-emitting apparatuses provided with discharge tube employed as a light source typically for phototherapeutic and prevention apparatuses and stroboscopic devices.

BACKGROUND ART

Light-emitting apparatuses have been used for phototherapeutic and prevention apparatuses that prevent disease or reduce symptoms of disease by photoradiation, and for stroboscopic devices that emit light to a photographic subject.

A conventional light-emitting apparatus includes a discharge tube as a light source, and a light emission control circuit for controlling light emission from the discharge tube. The discharge tube includes a tubular glass bulb in which noble gas is enclosed, and a pair of electrodes attached to both ends of the glass bulb. The discharge tube and the light emission control circuit are connected via a lead wire, and contacts of the lead wires at the side of the discharge tube are connected to a pair of electrodes of the discharge tube. In general, this pair of electrodes and the lead wires are connected by soldering (e.g., PTL1 to PTL3). Accordingly, electrical connection is ensured by soldering the pair of electrodes and the lead wires. In addition, a structure to increase contact of the electrodes and lead wires by covering a connected part of the pair of electrodes and the lead wire with a heat-shrink tube is disclosed (e.g., paragraph 0060 and FIG. 7 of PTL3).

However, in repetitive emission or continuous emission from the discharge tube of the light-emitting apparatus, heat is generated by light emission. Generated heat accumulates at solder of the connected parts of the electrodes of the discharge tube and the lead wires, and thus the solder becomes hot. If the discharged tube is continuously used in the above condition, solder of the connected part stays hot, and solder becomes easily dissolved. As a result, the bonding strength of solder connecting the electrodes and lead wire reduces.

CITATION LIST

Patent Literature

PTL1 Japanese Patent Unexamined Publication No. H09-90481

PTL2 Japanese Patent Unexamined Publication No. 2002-164021

PTL 3 Japanese Patent Unexamined Publication No. 2009-238553

SUMMARY OF THE INVENTION

To solve the above disadvantage, a discharge tube of the present invention includes a glass bulb in which noble gas is enclosed, a pair of electrodes protruding from both ends of the glass bulb in the longitudinal direction of the glass bulb, and connectors connected to each of the electrodes. Still more, each of the electrodes at least includes an axis section, and a large-diameter section with a step section and a circumferential face. The step section includes a first latching section for latching onto the connector. The circumferential face includes a contact section with which the connector comes in contact. The connector includes a connector body into which the electrode is inserted, a second latching section for latching onto the first latching section of the electrode, and a connecting section connected contact section of the electrode. With this structure, a discharge tube with high connection reliability via the connector and high heat radiation efficiency can be achieved without using solder.

A light-emitting apparatus of the present invention includes the discharge tube as configured above. This structure thus achieves the light-emitting apparatus with high connection reliability and high heat radiation efficiency.

DESCRIPTION OF EMBODIMENTS

A discharge tube and a light-emitting apparatus provided with discharge tube are described below with reference to drawings, taking a phototherapeutic and prevention apparatus as an example. The exemplary embodiment described herein is illustrative and not restrictive, and thus the present invention is in no way limited to this embodiment

Exemplary Embodiment

A light-emitting apparatus in the exemplary embodiment of the present invention is described below with reference to FIGS. 1 and 2, taking a phototherapeutic and prevention apparatus as an example.

Phototherapeutic and prevention apparatus 1 is an example of the light-emitting apparatus that emits therapeutic light to a user receiving medical treatment, such as a patient receiving preventive care for inflammatory disease, a patient receiving preventive care for reducing symptom of disease, and a patient receiving treatment for inflammatory disease by suppressing inflammatory disease. In this exemplary embodiment, the light-emitting apparatus is thus indicated as the phototherapeutic and prevention apparatus in the description.

Figure 1:
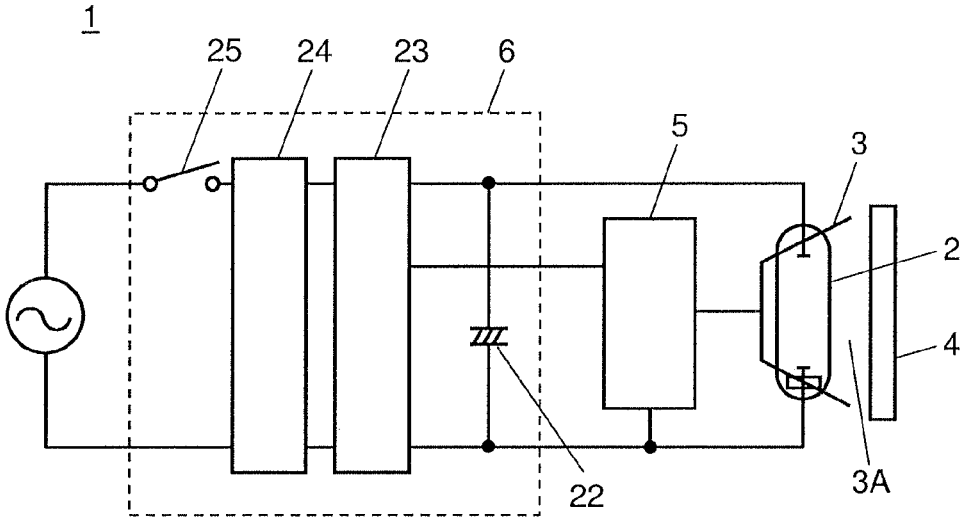
FIG. 1 is a schematic diagram that includes a control circuit of a phototherapeutic and prevention apparatus in accordance with an exemplary embodiment of the present invention.

FIG. 1 is a schematic diagram that includes a control circuit of the phototherapeutic and prevention apparatus in the exemplary embodiment of the present invention. FIG. 2 is a perspective appearance view of the phototherapeutic and prevention apparatus in the exemplary embodiment.

Figure 2:
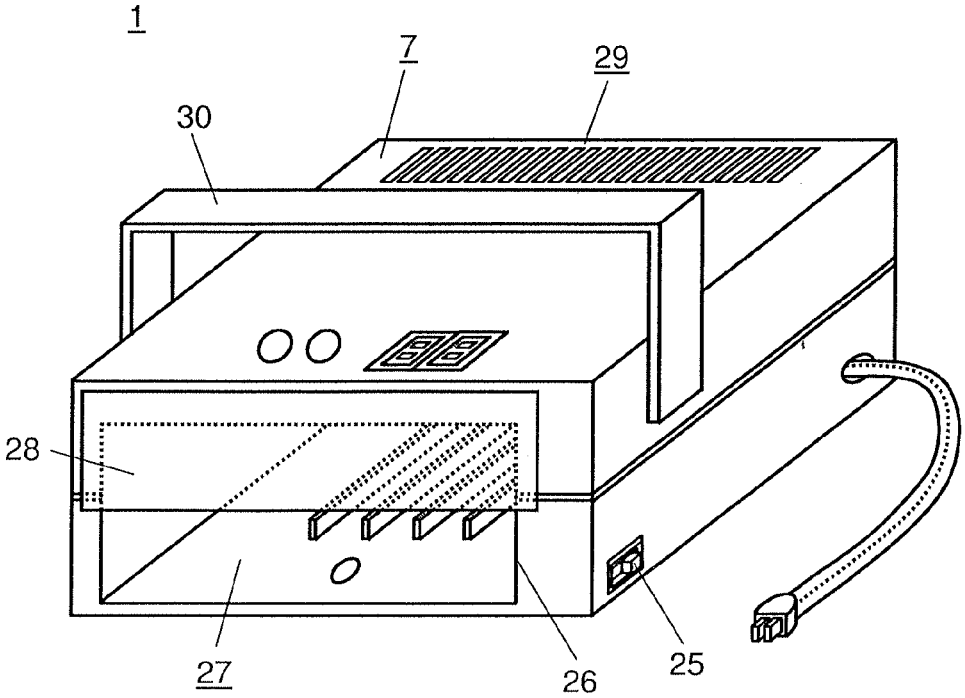
FIG. 2 is a perspective appearance view of the phototherapeutic and prevention apparatus in accordance with the exemplary embodiment.

As shown in FIGS. 1 and 2, phototherapeutic and prevention apparatus 1 in the exemplary embodiment at least includes discharge tube 2, reflector 3, wavelength transmitter 4, light emission controller 5, and power feeder 6 in apparatus body 7. Discharge tube 2 emits light and radiate light outside by supplying power from external power source via power feeder 6 and light emission controller 5. Reflector 3 reflects the light radiated from discharge tube 2 to a subject. Wavelength transmitter 4 passes through irradiated light in a specified frequency band in wavelengths of the light radiated from discharge tube 2. Light emission controller 5 controls light emission from discharge tube 2. Power feeder 6 controls power from the power source to supply power required in discharge tube 2 and light emission controller 5.

More specifically, reflector 3 is housed inside discharge tube 2 and has opening 3A for radiating light emitted from discharge tube 2. Reflector 3 reflects the light emitted from discharge tube 2 and radiates the light through opening 3A to outside (subject) via wavelength transmitter 4.

Wavelength transmitter 4 is configured with an optical filter that transmits only one or more specific wavelengths or wavelengths in one or more specific bands in the light radiated from discharge tube 2. Wavelength transmitter 4 in the exemplary embodiment is configured with a band pass filter (interference filter) that selectively transmits irradiated light only in specific wavelengths (band).

Light emission controller 5 receives emission condition setting of discharge tube 2, and includes an emission operation controller having a function of self-diagnosis, a function to respond to self-diagnosis result, and an operation display for displaying the operation state of the emission operation controller.

In other words, the emission operation controller controls light emission from discharge tube 2, using diversifying light emission patterns. For example, discharge tube 2 is flashed once or multiple times. If discharge tube 2 is flashed multiple times, energy radiated from discharge tube 2 may be suppressed to predetermined radiation energy or below at flashing. The emission operation controller also controls discharge tube 2 to emit light at a predetermined emission interval.

The operation display includes irradiation state display LED, warning LED, and standby time display (e.g., seven-segment display). The irradiation state display LED displays the state whether or not discharge tube 2 is ready for irradiation. Warning LED warns the user by notifying occurrence of failure in phototherapeutic and prevention apparatus 1. Standby time display displays a standby time required until discharge tube 2 becomes ready for next irradiation.

As shown in FIG. 1, power feeder 6 includes power storage 22, charging circuit 23, power supply 24, and power switch 25 (see FIG. 2) for switching ON and OFF of power supply 24. Power storage 22 stores emission energy of discharge tube 2. Charge circuit 23 charges power storage 22. Power supply 24 supplies electricity to power storage 22. Power switch 25 switches ON and OFF of power supply 24.

As shown in FIG. 2, apparatus body 7 of phototherapeutic and prevention apparatus 1 at least includes one opening 26. For example, apparatus body 7 is formed in a substantially cuboid (including cuboid) and configures a casing for housing discharge tube 2, reflector 3, wavelength transmitter 4, light-emission controller 5, and power feeder 6.

Apparatus body 7 includes placement section 27, light leak blocker 28, cooler 29, and handle 30 for holding apparatus body 7 to carry. Placement section 27 is, for example, a table where a user inserts a hand through opening 26 formed on one face (hereafter referred to as "front face") to apply irradiated light with wavelength in a specified range to the hand. Light leak blocker 28 prevents leak from opening 26 of the light radiated from discharge tube 2 in placement section 27. Cooler 29, such as a cooling fan, cools down inside apparatus body 7 that becomes high temperature typically by discharge tube 2, which is a heat source.

The structure, operation, and effect of discharge tube 2, which is a key point of this exemplary embodiment, is described below with reference to FIGS. 3 to 6.

Figure 3:
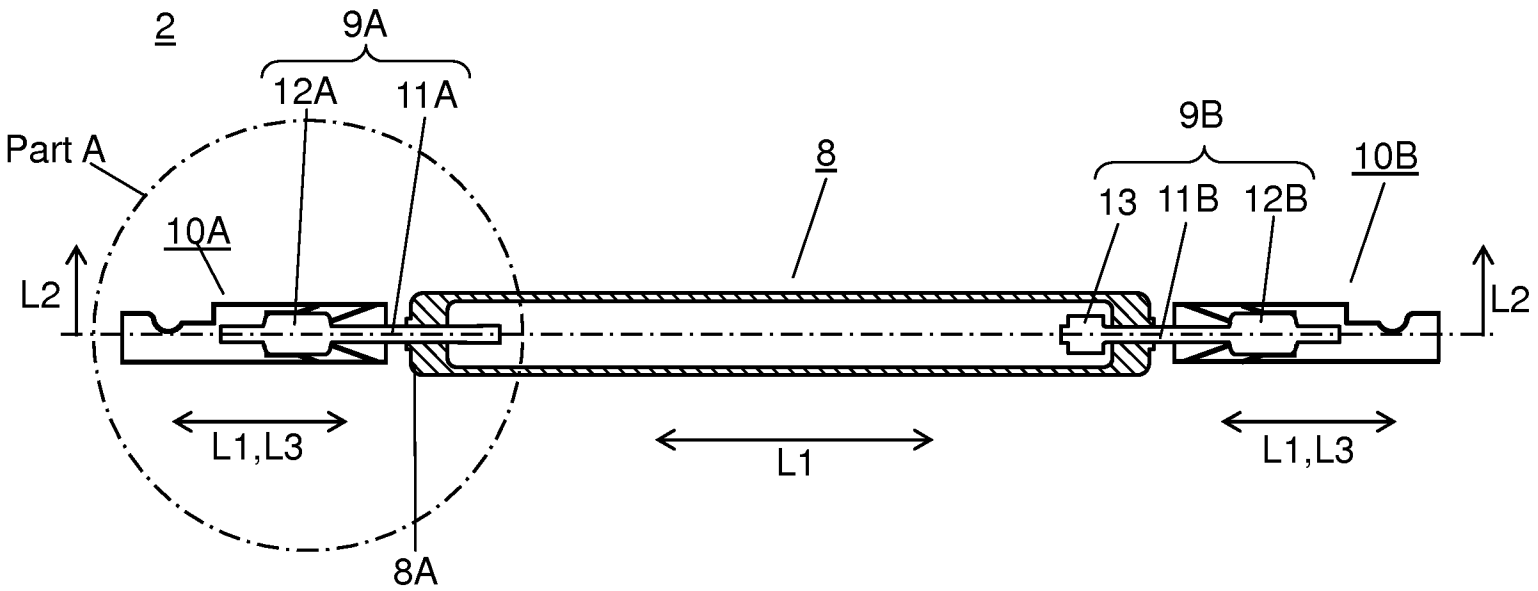
FIG. 3 is a sectional view of a discharge tube in accordance with the exemplary embodiment.
Figure 4:
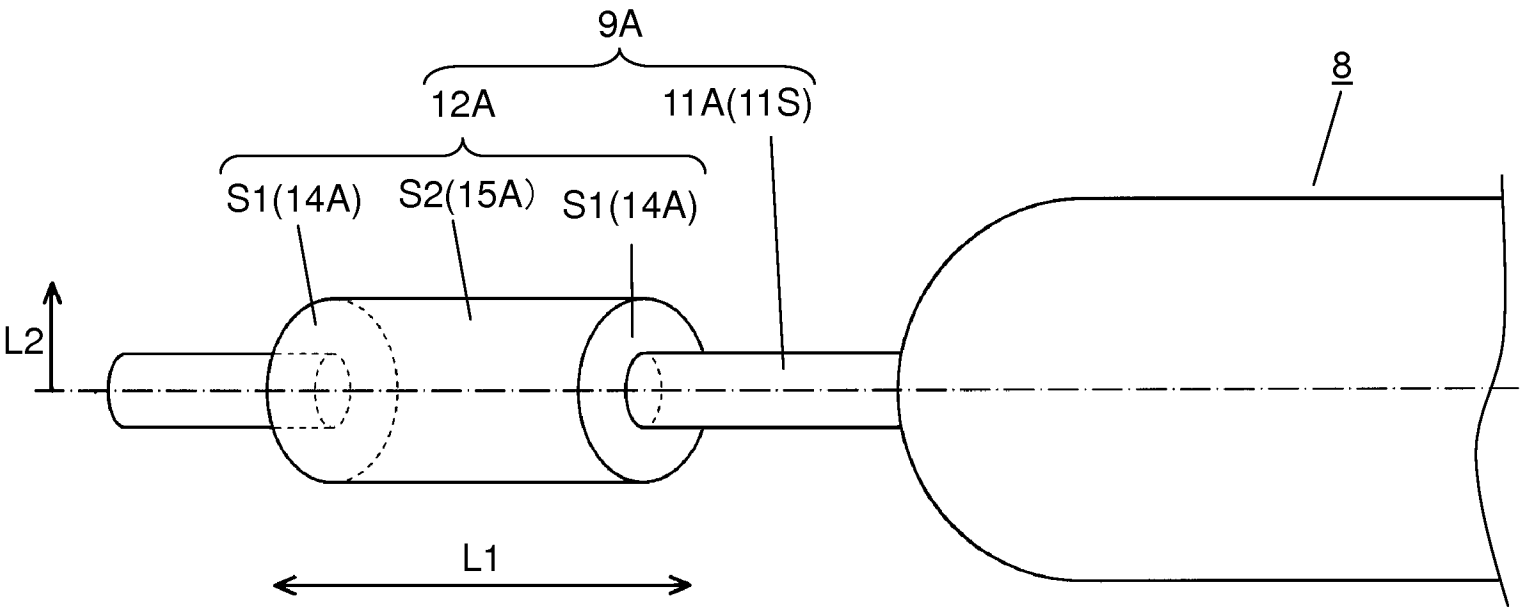
FIG. 4 is a fragmentary perspective view illustrating an electrode structure of the discharge tube in accordance with the exemplary embodiment.
Figure 5:
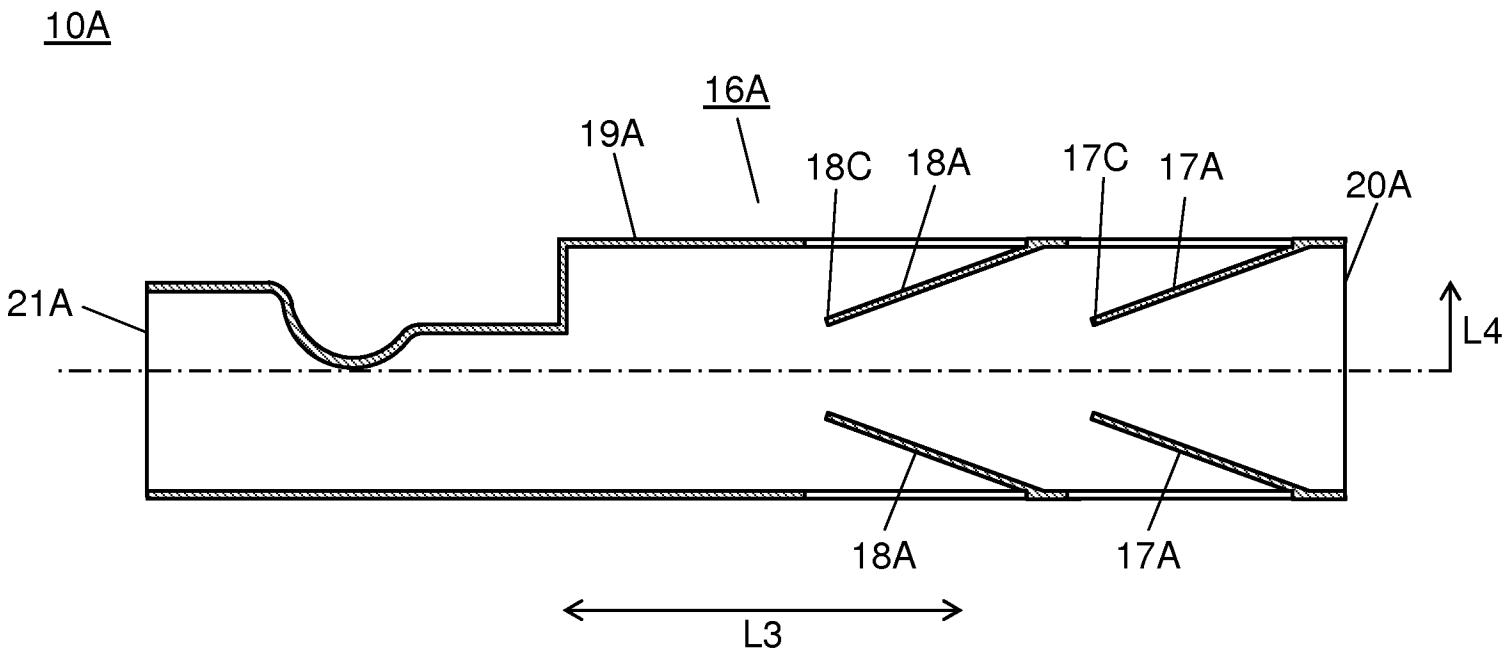
FIG. 5 is a sectional view of a connector in accordance with the exemplary embodiment.
Figure 6:
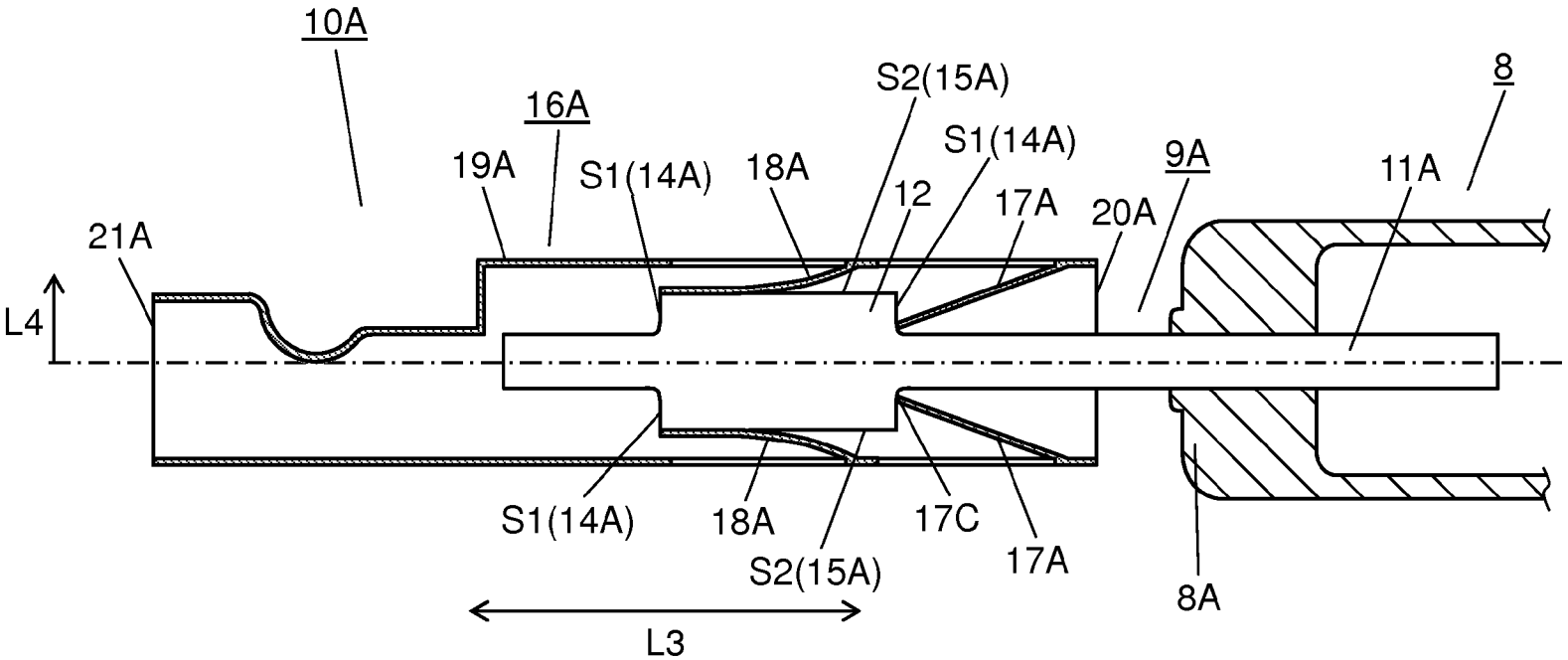
FIG. 6 is a magnified sectional view of part A in FIG. 3.

FIG. 3 is a sectional view of the discharge tube in the exemplary embodiment. FIG. 4 is a fragmentary perspective view illustrating an electrode structure of the discharge tube in the exemplary embodiment. FIG. 5 is a sectional view of the connector in the exemplary embodiment. FIG. 6 is a magnified sectional view of part A of FIG. 3.

Discharge tube 2 is a light source in a light-emitting apparatus, such as a phototherapeutic and prevention apparatus, for radiating light to user's part of body for applying preventive care or to diseased part of body for suppressing production of inflammatory cytokine. For example, the discharge tube is configured with a flash discharge tube, such as xenon discharge tube. In this exemplary embodiment, a xenon discharge tube is described as an example of discharge tube 2.

As shown in FIG. 3, discharge tube 2 in this exemplary embodiment includes cylindrical glass bulb 8 in which noble gas such as xenon is enclosed, a pair of electrodes 9A and 9B with a predetermined radius provided on both ends of glass bulb 8, and connectors 10A and 10B connectable to electrodes 9A and 9B. A pair of electrodes 9A and 9B provided at both ends of glass bulb 8 in longitudinal direction L1 are welded and sealed to glass bulb 8 in a state that a part of each of electrodes 9A and 9B is inserted.

Glass bulb 8 is formed of hard glass, such as borosilicate glass. Light is generated by collision of electrons against noble gas enclosed in glass bulb 8. Generated light is radiated outward to a subject.

A pair of electrodes 9A and 9B is formed of bar metal, such as tungsten. They are provided at both ends of glass bulb 8. In this exemplary embodiment, electrode 9B is cathode electrode (negative electrode) and electrode 9A is an anode electrode (positive electrode).

Electrode 9A configuring the anode electrode includes a long axis section 11A with predetermined radius, extending from inside glass bulb 8, and large-diameter section 12A with predetermined length provided on a part of axis section 11A outside of the end of glass bulb 8 in longitudinal direction L1. Large-diameter section 12A means that its diameter is larger than axis section 11A with predetermined radius.

On the other hand, electrode 9B configuring the cathode electrode also includes, same as electrode 9A, long axis section 11B with predetermined radius, extending from inside glass bulb 8, and large-diameter section 12B with predetermined length provided on a part of axis section 11B outside of the end of glass bulb 8 in longitudinal direction L1. Sintered metal body 13 configured with, for example, a mixture of fine metal powder of tungsten and tantalum or a mixture of fine metal powder of tantalum and nickel is provided at a tip of axis section 11B of electrode 9B inside glass bulb 8.

More specifically, one ends of axis sections 11A and 11B of electrodes 9A and 9B are inside glass bulb 8 from its both ends, respectively. On the other hand, the other ends of axis sections 11A and 11B of electrodes 9A and 9B protrude outward (outside) in longitudinal direction L1 from both ends of glass bulb 8.

Next, a structure of electrode 9A and its relationship with connector 10A are described with reference to electrode 9A configuring the anode electrode. In other words, a structure of electrode 9B configuring the cathode electrode and its relationship with connector 10B are same as that of electrode 9A except for metal sintered body 13. They are basically symmetric with different reference marks, and thus their description is omitted here.

First, as shown in FIGS. 3 and 4, large-diameter section 12A of electrode 9A includes step sections S1 forming steps from axis section 11A in radial direction L2, and circumferential face S2 formed outward from axis section 11A in radial direction L2 of electrode 9A between step sections S1. In other words, step sections S1 are ends of axis section 11A in radial direction L2 formed between circumferential face 11S of axis section 11A and circumferential face S2 of large-diameter section 12A. Step sections S1 form first latching sections 14A that latch onto connector 10A. Circumferential face S2 forms contact section 15A with which connector 10A comes in contact.

More specifically, large-diameter section 12A of electrode 9A is formed typically in a long cylindrical shape, such as by cutting, and protrudes outward from end 8A of glass bulb 8 in a protruding direction along longitudinal direction L1 of glass bulb 8 (hereafter using same reference mark L1 as the longitudinal direction). Large-diameter section 12A has cylindrical first latching section 14A on step section S1 in the longitudinal direction (protruding direction L1 of electrode 9A). Contact section 15A is provided on circumferential face S2 on cylindrical outer periphery. Large-diameter section 12A is provided by enlarging a diameter of axis section 11A in a direction perpendicular to the axial direction of axis section 11A (conforming to protruding direction L1 of electrode 9A). Large-diameter section 12A is provided at a midway position in the axial direction of axis section 11A that protrudes from end 8A of glass bulb 8. Accordingly, a space is formed between large-diameter section 12A and end 8A of glass bulb 8. This space enables to latch first latching section 14A of electrode 9A onto second latching section 17A of connector 10A.

As shown in FIGS. 3, 5, and 6, connector 10A includes tubular connector body 16A, second latching section 17A, and connecting section 18A.

Connector body 16A includes tube 19A with open ends, first opening 20A provided on one end of tube 19A for inserting electrode 9A, and second opening 21A provided on the other end for inserting a lead wire. Here, diameters of tube 19A and first opening 20A have the size that both axis section 11A and large-diameter section 12A of electrode 9A can be inserted. On the other hand, the diameter of second opening 21A has the size that the lead wire can be inserted.

Second latching section 17A is provided on the side of first opening 20A of connector body 16A, and latches onto first latching section 14A of electrode 9A in the state that electrode 9A is inserted into connector body 16A in tube axis direction L3.

Connecting section 18A electrically connects connector body 16A and contact section 15A of large-diameter section 12A of electrode 9A. This establishes connection between the lead wire connected to second opening 21A of connector 10A and electrode 9A of discharge tube 2.

More specifically, tip 17C of second latching section 17A protrudes inward from tube 19A of connector body 16A in a tilted manner, with respect to radial direction L4 of connector body 16A, in a direction from first opening 20A to second opening 21A. This makes second latching section 17A elastically deformable along the outer periphery of electrode 9A (circumferential face 11S of axis section 11A, circumferential face S2, and step sections S1 of large-diameter section 12A) when electrode 9A is, for example, inserted.

Second latching section 17A elastically deforms by bending toward tube 19A of connector body 16A along the outer peripheries of axis section 11A and large-diameter section 12A when electrode 9A is inserted from first opening 20A. Accordingly, axis section 11A and large-diameter section 12A of electrode 9A can be inserted into connector body 16A. Second latching section 17A is provided at one or more parts of connector body 16A in the inner circumferential direction, preferably, for example, at 3 to 4 parts at equal intervals along the same inner circumference in the inner circumferential direction of connector body 16A.

As shown in FIGS. 3 and 6, when large-diameter section 12A of electrode 9A is further inserted from second latching section 17A toward second opening 21A of connector body 16A, second latching section 17A elastically deformed toward tube 19A returns to its original state (before elastic deformation) and second latching section 17A protrudes inward from connector body 16A along step section S1 of large-diameter section 12A. At this point, second latching section 17A returns to the state protruding inward until it is in contact with circumferential face 11S of axis section 11A of electrode 9A.

When connector body 16A is pulled out from electrode 9A in the above state that electrode 9A is inserted in connector body 16A, second latching section 17A of connector body 16A is latched onto first latching section 14A, which is step section S1 of large-diameter section 12A of electrode 9A. Accordingly, second latching section 17A restricts pull-off of connector body 16A from electrode 9A.

Connecting section 18A of connector 10A is provided to the side of second opening 21A relative to second latching section 17A. In the same way as second latching section 17A, tip 18C of connecting section 18A is formed such that it protrudes inward from connector body 16A in a tilted manner. Therefore, when electrode 9A is inserted into connector body 16A, connecting section 18A is in contact with contact section 15A on circumferential face S2 of large-diameter section 12A of electrode 9A and thus connecting section 18A elastically deforms toward tube 19A. As a result, connecting section 18A of connector body 16A is pushed by contact section 15A of electrode 9A to establish electrical connection. In the same way as second latching section 17A, connecting section 18A is provided at one or more parts of connector body 16A in the inner circumferential direction, and preferably, for example, at 3 to 4 parts at equal intervals in the same inner circumference along the inner circumferential direction of connector body 16A.

With the above structure, discharge tube 2 in the exemplary embodiment, as shown in FIG. 3, is configured. By installing discharge tube 2 described above in a light-emitting apparatus, such as a phototherapeutic and prevention apparatus, a highly reliable and stable light-emitting apparatus can be achieved.

Next is described how to connect a pair of electrodes of the glass bulb and the connector in phototherapeutic and prevention apparatus 1 with reference to FIG. 6.

As described above, electrode 9A configuring the anode electrode is used as an example for describing the structure of electrode 9A and its relationship with connector 10A. In other words, the structure of electrode 9B configuring the cathode electrode and its relationship with connector 10B are the same as that of electrode 9A, except for metal sintered body 13. They are basically symmetric with different reference marks, and thus their description is omitted here.

As described above, electrode 9A is integrally fixed and provided at end 8A of glass bulb 8 of discharge tube 2. On the other hand, a lead wire (not illustrated) is inserted into connector body 16A from second opening 21A and then caulked and fixed in the state that the lead wire is electrically connected to second opening 21A. Then, by connecting electrode 9A of discharge tube 2 and connector 10A, power feeder 6 shown in FIG. 1 and discharge tube 2 can be connected via the lead wire.

Next, the relationship of electrode 9A of glass bulb 8 and connector 10A when connected and their operation and effect are detailed.

First, electrode 9A of glass bulb 8 is inserted into connector body 16A (tube 19A) from first opening 20A of connector body 16A in connector 10A. This makes electrode 9A come in contact with second latching section 17A of connector 10A.

Next, electrode 9A of glass bulb 8 is further inserted into connector 10A. At this point, second latching section 17A is in contact with axis section 11A and large-diameter section 12A of electrode 9A, and is pushed out along their outer peripheries from the state protruding inward from connector body 16A. Second latching section 17A is thus elastically deformed in the state pushed and bent along the inner periphery of connector body 16A. This secures a passage for inserting axis section 11A and large-diameter section 12A of electrode 9A inside connector 10A. As a result, electrode 9A can be inserted into connector 10A.

Next, electrode 9A of glass bulb 8 is further inserted into connector 10A. Tip 17C of second latching section 17A reaches the side of first opening 20A further from large-diameter section 12A of electrode 9A. At this point, second latching section 17A pushed and bent toward connector body 16A by large-diameter section 12A of electrode 9A is released from the pushing pressure of large-diameter section 12A. By the recovery force of second latching section 17A, second latching section 17A returns to its original state (before elastic deformation) of protruding inward from connector body 16A along step section S1 of large-diameter section 12A. When connector body 16A is pulled out from electrode 9A, second latching section 17A of connector body 16A is latched onto first latching section 14A, which is step section S1 of large-diameter section 12A of electrode 9A. As a result, second latching section 17A restricts pull-off of connector body 16A from electrode 9A.

On the other hand, connecting section 18A of connector 10A elastically deforms along the inner periphery of connector body 16A by large-diameter section 12A of electrode 9A. Therefore, connecting section 18A of connector 10A will be in the state pushed by contact section 15A of large-diameter section 12A of electrode 9A. Current travelling in connector 10A, supplied from power feeder 6 shown in FIG. 1 via the lead wire, is supplied to contact section 15A of electrode 9A of glass bulb 8 via connecting section 18A of connector 10A.

As described above, electrode 9A is fitted inside connector body 16A of connector 10A by inserting electrode 9A in connector 10A in the exemplary embodiment. In this state, second latching section 17A of connector 10A latches onto first latching section 14A of electrode 9A inserted in tube axial direction L3 of connector body 16A. This ensures connection of electrode 9A and connector 10A.

Still more, in the exemplary embodiment, electrical connection of electrode 9A and connector 10A is ensured by contact of connecting section 18A of connector 10A and contact section 15A of electrode 9A. Here, the lead wire is connected to connector 10A. Therefore, electrode 9A and the lead wire do not need to be directly connected typically by solder in discharge tube 2. Accordingly, electrode 9A and the lead wire can be indirectly connected via connector 10A. As a result, degradation of solder joint strength in a conventional electrode and lead wire can be solved. A highly reliable discharge tube can thus be achieved.

Still more, in the exemplary embodiment, axis section 11A and large-diameter section 12A configuring electrode 9A have cylindrical shapes with different predetermined radiuses. Therefore, for example, a heat capacity corresponding to a volume of increased portion of electrode 9A increases in large-diameter section 12A with large diameter. The heat radiation efficiency corresponding to increased surface area of electrode 9A also increases. As a result, heat generation from electrode 9A, due to heat generated by light emission of discharge tube 2, becomes less. Furthermore, expansion of noble gas enclosed in glass bulb 8, due to heat generated by light emission from discharge tube 2, is suppressed, and thus an increase of gas pressure inside glass bulb 8 can be suppressed. Accordingly, difficulty in light emission from discharge tube 2, due to increase of gas pressure inside glass bulb 8, can be suppressed. The reason is that density of atoms and molecules of enclosed noble gas generally increases when the gas pressure inside glass bulb 8 increases. Therefore, activity of discharged electrons is suppressed and discharge starting voltage rises. However, the heat radiation efficiency increases by providing large-diameter section 12A, and thus rise of the discharge starting voltage can be suppressed.

Still more, in the exemplary embodiment, electrode 9A comes into contact with connecting section 18A protruding inward from connector body 16A when electrode 9A is inserted into connector 10A. At this point, connecting section 18A of connector 10A comes into contact with contact section 15A of electrode 9A in the elastically deformed state. Therefore, connecting section 18A of connector 10A is connected to contact section 15A of electrode 9A in the pressed state. As a result, electrical connection of electrode 9A and connector 10A can be ensured.

The light-emitting apparatus, such as a phototherapeutic and prevention apparatus, of the present invention is not limited to the above exemplary embodiment. It is apparent that a range of modifications within the intention of the present invention are applicable.

For example, the above exemplary embodiment describes phototherapeutic and prevention apparatus 1 for emitting light to hands. However, the present invention is not limited to emission to hands. For example, light may be emitted to other parts of body or other diseased parts of body for suppressing or preventing generation of inflammatory cytokine. Light may be emitted to any parts of body, including shoulder, lower back, foot, and entire body. In addition to emission to human being, the light may be emitted to a predetermined part of body of living subjects other than human being, such as animal, for medical treatment purposes. In this case, the present invention is not limited to the structure of phototherapeutic and prevention apparatus 1 in the exemplary embodiment. It is apparent that the structure can be changed as required to suit a predetermined part of body to be irradiated.

Still more, the exemplary embodiment refers to discharge tube 2 with structure of providing large-diameter section 12A of electrode 9A at one part of axis section 11A. However, the present invention is not limited to this structure. For example, large-diameter section 12A of electrode 9A may be provided at multiple parts of axis section 11A in protruding direction L1 of electrode 9A. This can increase the heat radiation area of the electrode to further increase the heat radiation efficiency. In this case, all of multiple large-diameter sections 12A need to be provided at least outward (toward second opening 21A) from tip 17C of second latching section 17A when electrode 9A is inserted in connector 10A.

Still more, the exemplary embodiment refers to discharge tube 2 with structure that large-diameter section 12A of electrode 9A is formed on electrode 9A in advance. However, the present invention is not limited to this structure. For example, large-diameter section 12A of electrode 9A may be configured separately from axis section 11A and then integrated to configure electrode 9A. In this case, large-diameter section 12A is formed of a ring member with hole into which axis section 11A can be inserted. Axis section 11A is inserted into the hole of large-diameter section 12A and fixed typically by welding to form electrode 9A. Large-diameter section 12A of electrode 9A may also be formed of one or more fan-like members that can be attached along the outer periphery of axis section 11A. Also in this case, large-diameter section 12 made of fan-like member is fixed typically by welding along axis section 11A to form electrode 9A.

Figure 7A:
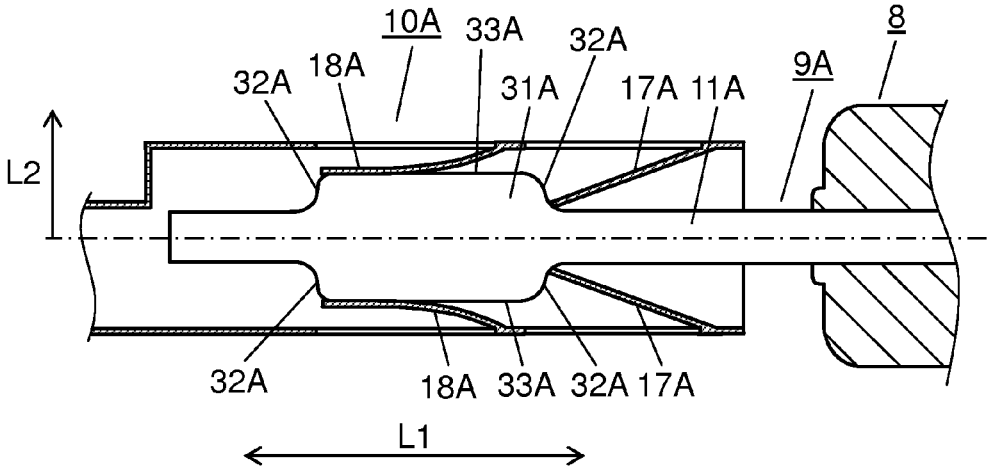
FIG. 7A is a fragmentary sectional view of another example of the electrode structure of the discharge tube in accordance with the exemplary embodiment.

Still more, the exemplary embodiment refers to discharge tube 2 in which large-diameter section 12A and axis section 11A of electrode 9A are formed by cutting work. However, the present invention is not limited to this processing method. For example, as shown in FIG. 7A, large-diameter section 31A may be formed by applying pressure to axis-section 11A in protruding direction L1 of electrode 9A and broadening (protruding) the diameter of a part of electrode 9A in radial direction L2. In this case, first latching section 32A of large-diameter section 31A of electrode 9A is formed as a step section from axis section 11A between the most-protruded portion and axis section 11A in radial direction L2. Contact section 33A of electrode 9A is formed on a portion most protruded from axis section 11A in radial direction L2. This enables to achieve good productivity for making electrode 9A, and thus a discharge tube can be achieved at low cost. By providing large-diameter section 31A in electrode 9A, the surface area and heat capacity of electrode 9A can be increased compared to the electrode formed only of axis section 11A. Accordingly, the heat radiation efficiency by electrode 9A can be improved. As a result, a phenomenon that discharge tube 2 becomes difficult to emit light, due to rise of gas pressure inside glass bulb 8, can be suppressed. A highly reliable discharge tube can thus be achieved.

Figure 7B:
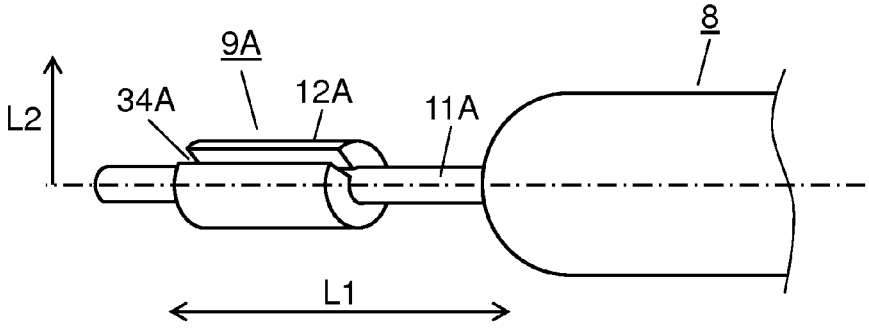
FIG. 7B is a fragmentary perspective view of another example of the electrode structure of the discharge tube in accordance with the exemplary embodiment.

Still more, the exemplary embodiment refers to discharge tube 2 in which large-diameter section 12A of electrode 9A is formed in a cylindrical shape with a predetermined length along longitudinal direction L1 of glass bulb 8. However, the present invention is not limited to this structure. As shown in FIG. 7B, large-diameter section 12A of electrode 9A may be provided in a ring shape with recessed section 34A in longitudinal direction L1. In this case, recessed section 34A formed in large-diameter section 12A of electrode 9A may be one or more grooves continuously formed from one end to the other end of large-diameter section 12A in longitudinal direction L1.

Figure 7C:
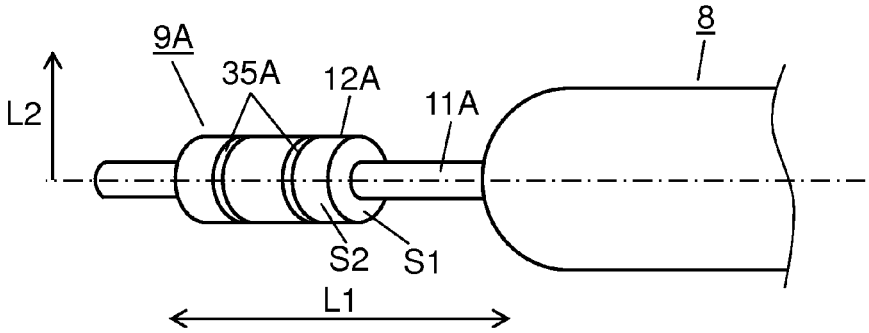
FIG. 7C is a fragmentary perspective view of another example of the electrode structure of the discharge tube in accordance with the exemplary embodiment.

Still more, as shown in FIG. 7C, one or more recessed sections 35A may be formed continuously in the circumferential direction on cylindrical large-diameter section 12A. Or, recessed sections 35A may be an inconsecutive hole with bottom or through hole formed on a part of the surface of large-diameter section 12A (step section S1 or circumferential face S2). This increases the surface area of electrode, compared to the electrode with only axis section or the electrode with large-diameter section without recessed section, and thus the heat radiation area can be further increased. As a result, the phenomenon that discharge tube 2 is difficult to emit light due to rise of gas pressure inside glass bulb 8 can be further suppressed. A highly reliable discharge tube can thus be achieved.

Still more, the exemplary embodiment refers to discharge tube 2 in which a distance between tips 17C of a pair of second latching sections 17A in connector 10A is almost the same as the diameter of axis section 11A of electrode 9A. However, the present invention is not limited to this distance. For example, tips 17C of the pair of second latching sections 17A of connector 10A may be provided at positions that tips 17C touch each other. This enables contact of connector 10A and axis section 11A of electrode 9A in a broad area, not only tips 17C of the pair of second latching sections 17A in connector 10A, when electrode 9A is inserted into connector 10A. As a result, a contact area of connector 10A and electrode 9A can be broadened to reduce contact resistance and also increase the heat radiation efficiency.

Still more, the exemplary embodiment refers to discharge tube 2 in which second latching section 17A and connecting section 18A of connector 10A are configured to establish planar contact between second latching section 17A or connecting section 18A of connector 10A and circumferential face 11S of axis section 11A of electrode 9A or circumferential face S2 of contact section 15A. However, the present invention is not limited to this structure. For example, second latching section 17A or connecting section 18A of connector 10A may have a curved shape similar to a curved face of circumferential face 11S of axis section 11A of electrode 9A or circumferential face S2 of contact section 15A. This broadens the contact area of connector 10A and electrode 9A, so as to reduce contact resistance and further improve the heat radiation efficiency.

Figure 8A:
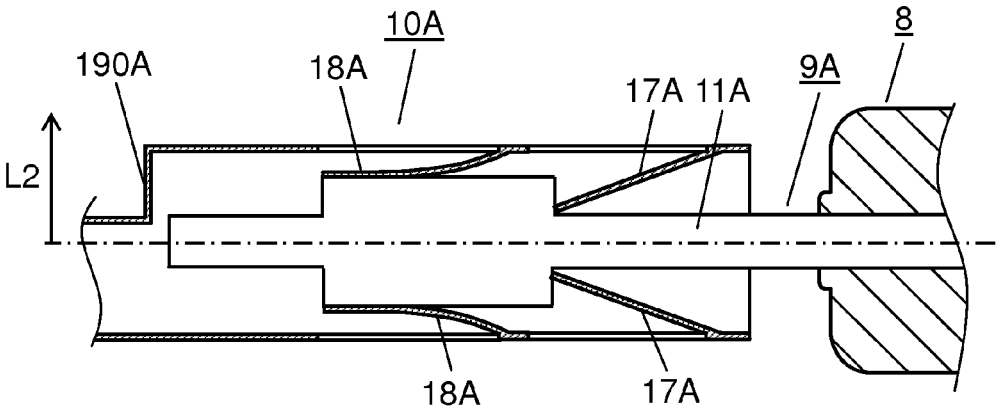
FIG. 8A is a fragmentary sectional view of another example of the structure of the connector in accordance with the exemplary embodiment.
Figure 8B:
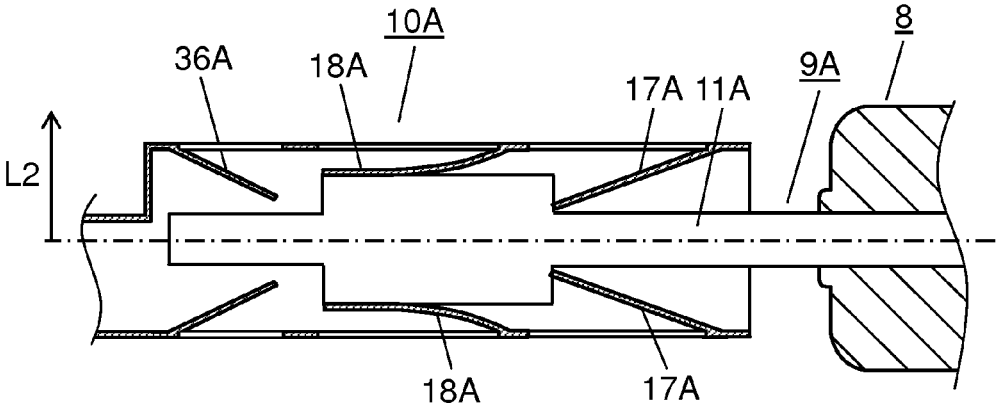
FIG. 8B is a fragmentary sectional view of another example of the structure of the connector in accordance with the exemplary embodiment.

Still more, the exemplary embodiment refers to discharge tube 2 in which insertion amount (length) of electrode 9A inserted to connector 10A is not restricted. However, the present invention is not limited to this structure. As shown in FIG. 8A, step section 190A may be provided on tube 19A of connector 10A at a tip of protruding axis section 11A of electrode 9A or up to a diameter that step section S1 of large-diameter section 12A comes into contact. Or, as shown in FIG. 8B, third latching section 36A may be provided toward first opening 20A at the side of second opening 21A of tube 19A of connector 10A and protruding inward of connector 10A, facing second latching section 17A and connecting section 18A. Third latching section 36A comes into contact with a tip of axis section 11A of electrode 9A or step section S1 of large-diameter section 12A. In this case, step 190A is provided at a position that first opening 20A of connector 10A and end 8A of second glass bulb 8 of discharge tube 2 do not contact in the state electrode 9A inserted to connector 10A is in contact with step 190A. This can prevent contact of connector 10A and end 8A of glass bulb 8 of discharge tube 2. As a result, a highly reliable discharge tube with good workability and assembly efficiency can be achieved.

As described above, the discharge tube of the present invention includes the glass bulb in which noble gas is enclosed, a pair of electrodes protruding from both ends of the glass bulb in the longitudinal direction of the glass bulb, and the connectors connected to each of the electrodes. Each of the electrodes includes at least the axis section and the large-diameter section with step section and circumferential face. The step section includes the first latching section for latching onto the connector. The circumferential section has the contact section with which the connector comes into contact. The connector includes the connector body into which the electrode is inserted, the second latching section for latching onto the first latching section of the electrode, and the connecting section connected to the connecting section of the electrode.

This structure enables to fit the electrode inside the connector body of the connector. The second latching section of the connector latches onto the first latching section of the electrode inserted in the tube axial direction of the connector body. This ensures connection of the electrode and the connector. In addition, contact of the connecting section of the connector and the contact section of the electrode ensures electrical connection of the electrode and the connector. For example, if the lead wire is connected to the connector, the electrode and the lead wire can be connected via the connector without connecting the electrode and the lead wire by soldering in the discharge tube. In addition, by providing the large-diameter section in the midway of the electrode, heat capacity corresponding to the increased volume of the electrode and the heat radiation efficiency corresponding to the increased surface area of the electrode can be increased. As a result, the heat accumulated in the electrode can be efficiently released so that the electrode of discharge tube 2 unlikely generates heat. Accordingly, a discharge tube with high connection reliability and high heat radiation efficiency can be achieved without using solder.

Still more, the large-diameter section has a cylindrical shape in the discharge tube in the exemplary embodiment. The first latching section is provided on the step section in the cylindrical large-diameter section, and the contact section is provided on the circumferential face of the cylindrical large-diameter section.

The cylindrical electrode in this structure can increase the heat capacity corresponding to the increased volume of electrode and the heat radiation efficiency corresponding to the increased surface area of the electrode. As a result, the heat accumulated in the electrode is efficiently released, making the electrode of discharge tube 2 difficult to generate heat.

Still more, in the discharge tube of the present invention, the connecting section protrudes inward from the connector body so that the connecting section elastically deforms when the connecting section is in contact with the contact section of the electrode.

With this structure, the electrode comes into contact with the connecting section protruding inward from the connector body when the electrode is inserted into the connector. At this point, the connecting section of the connector comes into contact with the contact section of the electrode in the elastically-deformed state. The connecting section of the connector is thus connected to the contact section of the electrode in the pressed state. As a result, electrical connection of the electrode and the connector can be ensured.

Still more, in the discharge tube of the present invention, the large-diameter section further includes the recessed section. By providing the recessed section in the electrode, the heat radiation efficiency corresponding to the increased surface of the electrode can be increased. As a result, the heat accumulated in the electrode can be efficiently released to decrease heat generation from the electrode of discharge tube 2.

Still more, in the discharge tube of the present invention, the connector further includes the step section or the third latching section for preventing the electrode from being inserted beyond the predetermined length. This prevents contact of the connector and the end of the glass bulb of the discharge tube.

Furthermore, the light-emitting apparatus of the present invention includes the discharge tube as configured above. This structure achieves the light-emitting apparatus with high connection reliability and high heat radiation efficiency.

INDUSTRIAL APPLICABILITY

The present invention is effectively applicable to discharge tubes and light-emitting apparatuses that require high reliability and high heat radiation efficiency for repetitive light emission or continuous light emission from the discharge tube.

REFERENCE MARKS IN THE DRAWINGS

1 Phototherapeutic and prevention apparatus (light-emitting apparatus)
2 Discharge tube
3 Reflector
3A Opening
4 Wavelength transmitter
5 Light emission controller
6 Power feeder
7 Apparatus body
8 Glass bulb
8A End
9A, 9B Electrode
10A, 10B Connector
11A, 11B Axis section
11S, S2 Circumferential face
12A, 12B, 31A Large-diameter section (Cylindrical section)
13 Metal sintered body
14A, 32A First latching section
15A, 33A Contact section
16A Connector body
17A Second latching section
17C, 18C Tip
18A Connecting section
19A Tube
20A First opening
21A Second opening
22 Power storage
23 Charge circuit
24 Power supply
25 Power switch
26 Opening
27 Placement section
28 Light leak preventive section
29 Cooler
30 Handle
34A, 35A Recessed section
36A Third latching section
190A, S1 Step section
L1 Longitudinal direction (protruding direction)
L2 Radial direction
L3 Tube axial direction

The invention claimed is:

1. A discharge tube comprising:

a glass bulb in which noble gas is enclosed;

a pair of electrodes protruding from both ends of the glass bulb in a longitudinal direction of the glass bulb; and a connector connected to each of the electrodes, wherein each of the electrodes includes at least an axis section and a large-diameter section having a step section and a circumferential face, the step section includes a first latching section for latching onto the connector, the circumferential face includes a contact section with which the connector comes in contact, the connector includes a connector body into which the electrode is inserted, a second latching section for latching onto the first latching section, and a connecting section connected to the contact section of the electrode, and the connecting section protrudes inward from the connector body so that the connecting section elastically deforms when the connecting section is in contact with the contact section of the electrode.

2. The discharge tube of claim 1, wherein the large-diameter section has a cylindrical shape, the first latching section is provided on the step section in the cylindrical shape, and the contact section is provided on the circumferential face in the cylindrical shape.

3. The discharge tube of claim 1, wherein the large-diameter section further includes a recessed section.

4. The discharge tube of claim 1, wherein the connector further includes one of a step section and a third latching section for preventing the electrode from being inserted beyond a predetermined length.

5. A light-emitting apparatus equipped with the discharge tube of claim 1.

* * * * *